US006291127B1

(12) United States Patent
Dagan et al.

(10) Patent No.: US 6,291,127 B1
(45) Date of Patent: Sep. 18, 2001

(54) WATER-BORNE POLYESTER COATED IMAGING MEMBER

(75) Inventors: Sandra J. Dagan, Churchville; Suresh Sunderrajan, Rochester; Charles E. Romano, Jr., Rochester; Robert A. Guistina, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/644,332

(22) Filed: Aug. 23, 2000

(51) Int. Cl.[7] ..... G03C 8/52; G03C 1/79; B41J 2/01; B05D 3/12

(52) U.S. Cl. ..... 430/201; 430/212; 430/531; 430/533; 430/538; 430/532; 347/105; 162/136; 162/164.7; 162/164.6; 427/365

(58) Field of Search ..... 430/538, 531, 430/533, 532, 201, 212; 347/105; 162/136, 164.7, 164.6; 427/365

(56) References Cited

U.S. PATENT DOCUMENTS

| | | | | |
|---|---|---|---|---|
| 4,370,389 | | 1/1983 | Ogura et al. | 428/511 |
| 4,645,736 | | 2/1987 | Anthonsen et al. | 430/538 |
| 4,675,245 | * | 6/1987 | Von Meer | 430/538 |
| 4,977,191 | | 12/1990 | Salsman | 521/48 |
| 5,093,449 | | 3/1992 | Durney Cronin et al. | 526/318 |
| 5,182,161 | * | 1/1993 | Noda et al. | 430/538 |
| 5,281,630 | * | 1/1994 | Salsman | 521/48.5 |
| 5,684,052 | | 11/1997 | Krisnan et al. | 521/40.5 |
| 5,858,551 | | 1/1999 | Salsman | 428/480 |
| 5,874,148 | | 2/1999 | Hough et al. | 428/95 |
| 5,897,411 | | 4/1999 | Stark et al. | 428/511 |
| 5,900,115 | | 5/1999 | Kuroyama et al. | 162/135 |
| 5,958,601 | * | 9/1999 | Salsman | 428/480 |
| 6,051,107 | | 4/2000 | Varnell | 162/135 |

OTHER PUBLICATIONS

*Corona Sparks New Interest for Treating Large 3–D Parts*, Plastics Technology, Feb. 1993, pp.58–61.

* cited by examiner

*Primary Examiner*—Richard L. Schilling
(74) *Attorney, Agent, or Firm*—Paul A. Leipold

(57) ABSTRACT

The invention relates to an imaging member comprising at least one image layer and a base, said base comprising a cellulose paper that has its surfaces impregnated with water dispersible ester-based condensation polymer wherein the surface of said base has a roughness of less than 2.03 $\mu$m Ra and a hydrophobicity as measured by 40/20 Acid Valley test in excess of 500 seconds.

63 Claims, No Drawings

WATER-BORNE POLYESTER COATED IMAGING MEMBER

FIELD OF THE INVENTION

This invention relates to imaging supports and media. In a preferred form it relates to base materials for inkjet, thermal, and photographic papers.

BACKGROUND OF THE INVENTION

Imaging bases, particularly photographic imaging bases, need to be able to resist liquid penetration in order to prevent print drying and print transport problems during photofinishing as well as subsequent print quality problems such as yellow edges. The use of 'sizing' to induce some degree of liquid hold-out in paper is well known in the art. Sizing chemicals are typically added to papermaking fibers prior to the formation of the sheet (internal sizing) or added to the surface of a sheet that has been, at least partially, dried, (surface sizing). In the past, "sized" cellulosic paper bases alone have not been able to provide adequate liquid hold-out characteristics, limiting their application or necessitating additional processing steps. For example, fiber base sheets without special waterproofing layers, such as Black and White professional fiber base papers, are used in some photographic applications but require additional print drying times, making these papers non-functional in high speed commercial photofinishing equipment. Wetting of the cellulose fibers in the fiber sheet also results in weaker tensile strengths limiting the amount of tensile force that can be applied to transport the paper through the photofinishing equipment. Liquid holdout is also important for inkjet papers since penetration of ink into traditional cellulose papers causes a distortion of the paper surface known as cockle. In addition to the cockle manifesting as an unsightly surface, the non-planar distortion can also cause headstrikes in wide format ink jet printers thus resulting in density streaks.

In the prior art, adequate liquid hold-out for imaging base applications is typically provided through the use of polymeric protective layers. An imaging base such as a photographic paper typically comprises a cellulosic paper base that is extrusion-coated on both sides with a polyolefin resin liquid hold-out layer. An alternative imaging base proposed in U.S. Pat. No. 5,866,282 (Bourdelais et al), is made of cellulosic paper base laminated with biaxially oriented polyolefin sheets which provide the necessary liquid hold-out. The use of polymeric protective layers as described above is, however, perceived as a disadvantage by consumers. In voice of customer surveys, fiber base papers exhibit advantages over resin coated papers in that the feel of the fiber base paper is preferred over "plastic" coated papers, which many consumers and professional photographers perceive as "imitation paper".

Salsman U.S. Pat. No. 5,958,601 describes stearic acid esters. Salsman U.S. Pat. No. 5,281,630 describes water-dispersible polyester polymers.

Support coatings hardened with electron beams are disclosed in U.S Pat. No. 4,645,736 (Anthonsen et al) using a radiation hardened varnish and barrier layer. The barrier layers in the latter case, both extrusion and aqueous coated, are aimed at providing a fog barrier rather than a liquid holdout layer with the subsequent coatings that are treated with electron beams providing the waterproofness. The need for multiple operations to coat both sides of the paper make this method less than optimum since water must be removed from the back side of the paper during the hardening process on the side eventually receiving the light sensitive layer.

As typical for many high-value imaging bases, there are other properties that are also important. The underlying support should be stiff, to resist bending forces, yet smooth. A base paper with high tensile modulus and stiffness resists undesirable deformation and curl that result when exposed to certain handling and environmental conditions. For example, many photographic papers exhibit increased curl on being exposed to low humidity conditions. Stiffer papers, that lie flat within the same plane regardless of handling and environmental conditions, are perceived by the end-user to be of higher value due to a more substantial 'feel'.

Surface appearance is also important to the consumer. Surfaces with "orange peel" or low frequency roughness are visually dissatisfying while high frequency roughness is known to relate to poor final product gloss. Papers with lower surface roughness have been shown to enhance the gloss of a photographic print as measured using specular reflection measurement techniques. In order to achieve the properties listed above, imaging paper bases typically utilize bleached hardwood chemical kraft pulp as it provides acceptable base surface and good formation while maintaining strength and stiffness. To further smooth the paper base surface, it is common to machine calender the paper and then coat it with mineral pigments such as baryta, kaolin clay, calcium carbonate etc., or extrusion coat with polyolefins, or laminate with biaxially oriented films.

PROBLEM TO BE SOLVED BY THE INVENTION

Polymeric liquid hold-out layers that are typically extrusion coated or laminated to cellulosic paper base impart a "plastic" feel to imaging bases. From voice of customer surveys, this feel is disliked by consumers and professional photographers and is perceived to be of lower quality. Providing adequate liquid hold-out while improving cost efficiency and maintaining the fibrous feel of the imaging base is the problem to be solved. Liquid holdout and/or waterproofing characteristics of photographic papers are essential to maintain the image quality of photographic prints during the developing process while the base is submerged in developer. Waterproofing characteristics are also critical to the function of the imaging base in inkjet printers in order to prevent cockling or distortion of the surface that typically results from water penetration into the paper base.

SUMMARY OF THE INVENTION

It is an object of the invention to provide an imaging support that has superior resistance to liquid penetration and resultant cockle while providing a smooth surface appearance and a fiber base feel.

It is another object to provide an imaging support that has superior strength and resistance to curl adjusted for caliper differences.

It is a further object to provide an imaging support of high image quality in photographic applications.

It is a further object to provide an imaging support that does not cause cockle in ink jet printing applications.

These and other objects of the invention are accomplished by creating a highly refined, internally sized cellulose paper base that has its surfaces impregnated with a water dispersible ester based condensation polymer such that the impregnated paper exhibits a hydrophobicity as measured by 40/20 Acid Valley in excess of 500 seconds.

ADVANTAGEOUS EFFECT OF THE INVENTION

The invention provides an improved low cost paper for imaging elements. It particularly provides an improved paper that is resistant to liquid penetration while providing a preferred fiber base feel at low cost.

DETAILED DESCRIPTION OF THE INVENTION

The invention has numerous advantages over the prior art. Extruding polyolefin or laminating polyolefin sheets on paper support is slow and inefficient. Polymer resin coated and laminated structures are not repulpable. Both have a "plastic" feel and exhibit poor writability without a special backside coating. Both also require additional manufacturing operations (i.e., extrusion and/or lamination) in order to provide the liquid-holdout needed for image processing and printing. The invention provides an imaging element that provides similar liquid-holdout properties to comparable resin coated papers while exhibiting superior writability and maintaining fiber base feel. This increases the commercial value of the imaging element.

The invention also provides an imaging element that is more apt to resist bending as measured by L&W stiffness when compared with similar basis weight and caliper papers. These strength advantages are made possible by the inherent characteristics of imbibing a polyester based dispersion into a porous paper structure. The improved strength increases the perceived value of the imaging element since it reduces undesirable curl at similar base weights. While the preferred embodiment of this invention relates to silver halide imaging and ink jet printing, this invention is also useful as a base material for other imaging technologies such as thermal dye transfer printing and electrophotographic printing.

The invention has numerous advantages in simplifying the image base manufacturing process while providing professional paper features such as fiber feel, writability, and image quality. These and other advantages will be apparent from the detailed description below.

The imaging member of the invention comprises at least one image layer and a base, said base comprising a cellulose paper that has its surfaces impregnated with a water dispersible condensation polymer wherein the surface of said base has a roughness of less than 2.03 Ra and a hydrophobicity as measured by 40/20 Acid Valley test in excess of 500 seconds. Condensation polymers are well known in the art, a definition of which is found, for example, in C. E. Carraher, Jr., Polymer Chemistry, $4^{th}$ Ed., Marcel Dekker, New York, pp 211–261. Condensation polymers useful in this invention include polyesters, polyurethanes, block copolymers of polyesters and polyurethanes, polyethers, block copolymers of polyesters and polyethers, block copolymers of polyurethanes and polyethers.

In a preferred embodiment of the invention the condensation polymer is a water dispersible hydrophobic polyester resin having the following general formula:

$$I_n—P—A_m$$

wherein I is an ionic group; n is an integer in the range of 1–3 and defines the number of ionic groups; P is a polyester backbone; A is an aliphatic group; and m is an integer in the range of 3–8 and defines the number of aliphatic groups.

The ionic groups I which are required for water-dispersibility are typically derived from a carboxylic acid group which is introduced into the resin by polyacid monomers. The weight percent of ionic monomers in the resin is from 1% to 20%, with 5 to 10% of ionic monomer being preferred.

The backbone P of the polymer is composed of polyester groups. It can be any linear or branched polyester made using polyacids and polyalcohols. The weight percent of the polyester backbone ingredients range from 30–80% of the whole resin, with the most preferred being 50–60% by weight.

The aliphatic groups A consist of straight or branched 6–24 carbon chain fatty acids or triglycerides thereof. The weight percent of the aliphatic moiety can be 10–60% with 20–40% by weight being the preferred amount.

Specifically, the invention pertains to a water dispersible, hydrophobic polyester resin, comprising a reaction product of 30–70% by weight of a poly(ethylene terephthalate) condensation polymer; 5–40% by weight of a hydroxy functional compound having at least two hydroxyl groups; 1–20% by weight of a carboxy functional compound having at least two carboxyl groups and 10–60% by weight of a $C_6$–$C_{24}$ straight chain or branched fatty acid or triglycerides. The resin is further characterized in that the hydroxy functional compound is present at 1–3 times the equivalents of the hydrophobic moiety. The preparation of such hydrophobic polyester resins is described in detail in U.S. Pat. No. 5,958,601 (Salsman, 1999).

In another preferred embodiment of the invention the hydrophobic, water-dispersible polyester with general formula $I_n$—P—$A_m$ as described above is physically mixed with another water dispersed hydrophobic addition polymer such as carboxylated styrene butadiene. The addition polymer phase lends added hydrophobicity to the layer, as well as enhanced coating flexibility and serves as a diluent to the polyester component to minimize cross-linking which would deleteriously alter coating properties. Preferably, the physical mixture of the polymers will be applied to the paper base such that the polymers are coated simultaneously. However, sequential coating of the hydrophobic polyester and hydrophobic addition polymers is also envisioned in this invention.

A preferred aqueous dispersion of a mixture of carboxylated styrene butadiene copolymer and a hydrophobic polyester of the composition generally described above is commercially available as EvCote® PWRHS-37 from EvCo Research Incorporated, Atlanta, Ga., USA.

Examples of aromatic dicarboxylic acids useful in the backbone polyester polymer, P, employed in the invention include, but are not limited to, terephthalic, isophthalic, phthalic, and 2,6-naphthoic, succinic, glutaric, adipic, 1,4-cyclohexane dicarboxylic, maleic, fumaric, and azelaic.

The glycol component of polyester can be virtually any dihydroxy functional compound. Aliphatic and alicyclic glycols would be the most useful. Useful glycols include, but are not limited to, ethylene glycol, 1,3-propylene glycol, 1,2-propylene glycol, dipropylene glycol, tripropylene glycol, 1,4-butanediol, 1,5-pentanediol, 1,6-hexanediol, cyclohexanedimethanol, diethylene glycol, and triethylene glycol.

The backbone polyester consisting of any combination of the above polyacids and glycols may further directly include or incorporate by transesterification a multifunctional polyol selected from, but not limited to, glycerol, trimethylolpropane, erythritol, pentaerythritol, trimethylolethane, or a monosaccharide.

The ionic group $I_n$ needed for water-dispersibility can be a carboxylic acid which is introduced into the resin by polyacid monomers such as trimellitic anhydride, trimellitic acid, or maleic anhydride or sulfonate groups which come from monomerssuch as dimethyl 5-sulfoisophthalate (DMSIP or dimethyl 5-sulfo,1,3-benzenedicarboxylate), sulfoisophthalate ethylene glycol (SIPEG or dihydroxyethyl 5-sulfo1,3-benzenedicarboxylate, or from sulfonated alkenically unsaturated end groups as described in Salsman U.S. Pat. No. 5,281,630. The weight percent of ionic monomers in the resin is from 1% to 20%, but 1% to 10% is preferred.

The aliphatic groups, A, consist of 6–24 carbon chain fatty acids or triglycerides thereof such as stearic, oleic, palmitic, lauric, linoleic, linolenic, behenic acid, or their mixtures. These can come from hydrogenated or unhydrogenated animal or vegetable oil, such as beef tallow, lard, corn oil, or soy bean oil. The weight percent of the aliphatic moiety can be 10–60% with 20–40% the preferred amount.

Examples of water dispersible addition polymers useful in the invention include, but are not limited to carboxylated styrene butadiene, styrene/acrylate or methacrylate ester compositions containing acrylic or methacrylic acids, hydrolyzed styrene maleic anhydride copolymers, styrene maleic acid salt copolymers, styrene maleic ester copolymers, styrene (meth)acrylate copolymers, styrene (meth)acrylate ester copolymers, styrene acrylate ester acrylonitrile terpolymers, and acrylonitrile (meth)acrylate salt copolymers. The dispersions of these polymers in water must be stabilized either anionically or nonionically such as to maintain compatibility with the anionic hydrophobic polyester phase described above.

Polyurethane copolymers are also useful in this invention as hydrophobic condensation polymers. Polyurethanes are condensation copolymers consisting of one or more polyisocyanate monomers co-reacted with one or more polyhydroxy functional monomers. Polyisocyanate monomer pertains to molecules, aliphatic or aromatic, containing from 2 to 4 isocyanato functional groups per molecule. Polyhydroxy functional monomers pertain to aliphatic molecules which contain from 2 to 4 hydroxyl groups per molecule. In both cases 2 or 3 functional groups per molecule is preferred. The polyurethane must be water dispersible. Examples of polyisocyanate monomers useful in the invention include, but are not limited to, hexamethylene diisocyanate, 1,4-cyclohexane diisocyanate, 1,4-toluene diisocyanate, 1,3,5-triisocyanatobenzene, 1,3,5-triisocyanatocyclohexane, methylenecyclohexyl diisocyanate, isophorone diisocyanate, Mondur® CB-75, and methylenediphenyl diisocyanate.

The glycol components can be virtually any dihydroxy functional or polyol compound and mixtures thereof as listed above in the description of the hydrophobic polyester polymer.

Enhanced hydophobicity of the polyurethane is obtained by incorporation of aliphatic groups consisting of 6–24 carbon chain fatty alcohols such as hexyl, octyl, stearyl, oleyl, palmityl, lauryl, linoleyl, linolenyl, behenyl alcohols or their mixtures through reaction of the polyisocyanates with the hydrophobic alcohol. The hydrophobic groups thus are incorporated permanently into the polymer through hydrolytically stable urethane chemical linkages.

Water dispersibility of the polyurethane is obtained by incorporation of anionically functionalized diol monomers. A preferred anionic diol monomer is 2,2'-bis (hydroxymethyl) propionic acid. The monomers are rendered anionic by appropriate adjustment of the pH after the polymerization is completed.

The preferred paper is also comprised of highly refined cellulose fibers with a fiber length of individual fibers of said paper of between 0.4 and 0.9 mm externally sized with between 0.978 g/m$^2$ and 19.6 g/m$^2$ of the polyester/styrene butadiene mixture. This paper is preferred because it is smooth, strong, stiff, and liquid-resistant providing a high-quality cellulose paper for use as a reflective imaging output media whose smoothness and stiffness are perceptually preferred by consumers. Addition of less than 0.978 g/m$^2$ polyester resin does not provide a sufficient liquid-barrier, while the addition of over 19.6 g/m$^2$ polyester resin is costly and degrades the "fiber base texture" feel. The most preferred level of polyester resin is approximately 5 g/m$^2$ which provides adequate film forming and liquid-holdout, while maintaining a fiber base feel.

The preferred basis weight of the cellulose paper of the invention prior to impregnation with the barrier layer is between 110.0 and 250.0 g/m$^2$. A basis weight less than 110.0 g/m$^2$ yields an imaging support that does not have the required stiffness for transport through photofinishing equipment and digital printing hardware. Additionally, a basis weight less than 110.0 g/m$^2$ yields an imaging support that does not have the required stiffness for consumer preference. At basis weights greater than 250.0 g/m$^2$, the imaging support stiffness, while acceptable to consumers, exceeds the stiffness requirement for efficient photofinishing. Problems, such as the inability to be chopped and incomplete punches, are common with cellulose papers that exceed 250.0 g/m$^2$ in basis weight.

The preferred fiber length of the paper of this invention is between 0.40 and 0.90 mm. Fiber lengths are measured using a FS-200 Fiber Length Analyzer (Kajaani Automation Inc.). Fiber lengths less than 0.35 mm are difficult to achieve in manufacturing and, as a result, expensive. Because shorter fiber lengths generally result in an increase in paper modulus, paper fiber lengths less than 0.35 mm will result in a photographic paper that is very difficult to punch in typical photofinishing equipment. Paper fiber lengths greater than 0.90 mm result in a significant decrease in surface smoothness.

Any pulps known in the art to provide image quality paper may be used in this invention. Bleached hardwood chemical kraft pulp is preferred, as it provides brightness, an acceptable surface and good formation, while maintaining strength. Pulps with brightness of 90% or greater are commonly used in imaging supports because consumers typically prefer a white paper appearance. However, wood fibers such as those obtained from mechanical pulping, thermo-mechanical, thermo-chemical, and/or chemical pulping also could be used in making the paper base.

The internal chemistry of such papers is not limited, provided adequate internal sizing is present and can include typical papermaking sizing agents, wet strength and dry strength resins, fillers; dyes, synthetic fibers and other types of cellulose fiber.

Internal sizing chemicals commonly used are alkene ketene dimers, alkenyl succinic anhydrides, and anionic polyurethane sizes in neutral and/or alkaline pH conditions, while modified rosins, stearic acid or salts thereof, and aluminum salts are used in acidic pH conditions. It is common in the art to augment the liquid-holdout characteristics of the paper base through the use of external sizing in addition to internal sizing. The external sizing agents, needed to provide liquid hold-out, are primarily film formers such as starch, as well as synthetic polymers such as hydrolyzed styrene maleic anhydride copolymers, styrene maleic acid salt copolymers, styrene maleic ester copolymers, styrene (meth)acrylate copolymers, styrene (meth)acrylate ester copolymers, styrene acrylate ester acrylonitrile terpolymers, acrylonitrile (meth)acrylate salt copolymers and polyurethanes. For example, U.S. Pat. No. 4,434,269 discloses sizing agents for paper that are copolymers of acrylonitrile or methacrylonitrile, $C_1$–$C_{12}$ alkyl esters of acrylic acid and/or methacrylic acid. The copolymers are emulsified with a cationic polymeric emulsifier containing N,N'-dimethylaminoethyl acrylate or methacrylate, styrene, and acrylonitrile monomers. U.S. Pat. Nos. 5,116,924 and 5,169,886 disclose sizing agent dispersions containing cationic dispersant produced from the monomers: N,N'-dimethylaminoethyl acrylate and/or methacrylate; an acrylic and/or methacrylic acid ester of a $C_{10}$ to $C_{22}$ fatty alcohol; methyl acrylate and/or methacrylate; acrylic acid and/or methacrylic acid; and optionally butyl acrylate and/or butyl methacrylate and isobutyl acrylate and/or isobutyl methacrylate. U.S. Pat. No. 5,824,190 discloses a synthetic, polymeric surface size containing at least about 40 mole percent hydrophobic groups and a substantially hydrophilic polyacrylamide. U.S. Pat. No. 6,051,107 discloses sizing agents for paper that are copolymers of monomers comprising: (a) styrene or substituted styrene selected from the group consisting of alpha-methylstyrene and vinyl toluene; (b) alkyl acrylate or methacrylate; and(c) ethylenically unsaturated carboxylic acid. Fluorochemicals, polyurethane emulsion surface size additives, silicone resins in emulsion form, or chromium complexes of long chain fatty acids can also be used in combination as can cross-linking resins such as glyoxals or alkali-stabilized colloidal silicas.

The cellulose paper of this invention can be made on a standard continuous fourdrinier wire machine. For the formation of cellulose paper of this invention, it is necessary to refine the paper fibers to a high degree to obtain good formation. This is accomplished in this invention by providing wood fibers suspended in water, bringing said fibers into contact with a series of disc refining mixers, and conical refining mixers such that fiber development in disc refining is carried out at a total specific net refining power of 40 to 80 KW hrs/metric ton and cutting in the conical mixers is carried out at a total specific net refining power of between 40 and 90 KW hrs/metric ton, applying said fibers in water to a forming member to remove water, drying said paper between press and felt, drying said paper between cans, applying a size to said paper, drying said paper between steam heated dryer cans, applying steam to said paper, and passing said paper through calender rolls.

Said size solution can be externally applied to the fiber sheet by means of immersion in a sizing tub or by delivery of the solution to the nip between two press rolls. Conventional size press configurations (which tend to have a size pond at the nip where excess solution is allowed to remain) include, but are not limited to, horizontal, vertical, and inclined press designs. Modified size press configurations could also be used and include, but are not limited to, gate roll press designs and metering size press designs. Metering applications are well known in the papermaking industry, and pre-metering of the sizing material can be accomplished with a suitable metered applicator technique or a metering rod. Post metering size application is also possible with air knife coaters, stiff blade coaters, bent blade coaters, and rod coaters where control of size application is accomplished by applying and then removing any non-uniform excess solution. After the external sizing is applied, the paper then completes the drying process, is calendered using normal on-line papermaking operations, and is then off-line coated with appropriate image receiving layers to provide an imaging base. The size applied may be full strength (37% solids polyester resin) or applied in diluted concentrations. The preferred solids range is 7% to 25% and depends somewhat on the type of sizing application utilized. Factors affecting size pickup are well known in the industry and include, but are not limited to, paper density, smoothness, capillary structure, void size, level of internal sizing, moisture content, size solids content, size temperature, size viscosity, size additives, machine speed, pond depth, nip pressure, nip width, press roll hardness, and press roll diameter. Size solids is an especially well-known method of adjusting solution pickup. Normally reducing the solids will result in further penetration of the polymer into the sheet and in this instance has the potential of improving the dimensional stability of the sheet, thereby reducing cockle, although the barrier properties may be not as good as with a higher solids solution.

The sheet entering the sizing station should be dense, smooth, and highly refined to insure a pin-hole free, uniform film coating. Rougher papers with higher porosities will have more difficulty achieving a complete liquid barrier. Capillary pore size has been found to be critical in barrier coatings with the barrier layer having to fill or cover the pores to provide adequate liquid-holdout.

Dilutions may be done with water and/or other traditional or specialty sizes as defined in earlier discussions. Natural thickeners (such as Kelgin) or synthetic thickeners (such as carboxymethycellulose (CMC), hydroxyethylcellulose (HEC), and polyacrylamides) can also be used to modify the rheology of the size solution and, in turn, regulate the penetration of the size solution into the paper. Other chemical additives may also be added to the size solution for purposes including, but not limited to, colorimetry adjustment, gloss control, brightness control, curl modification, and static control. Examples include $TiO_2$, $CaCO_3$, optical brighteners, and dyes.

For the formation of cellulose paper of sufficient smoothness, it is desirable to rewet the paper surface prior to final calendering. Papers made on the paper machine with a high moisture content calender much more readily than papers of the same moisture content containing water added in a remoistening operation. This is due to partial irreversibility in imbibition of water by cellulose. However, calendering a paper with high moisture content results in blackening, a condition of transparency resulting from fibers in contact with each other being crushed. The crushed areas reflect less light and, therefore, appear dark, a condition that is undesirable in an imaging application such as a base for color photographic paper. By adding moisture to the surface of the paper after the paper has been machine dried, the problem of blackening can be avoided while preserving the advantages of high moisture calendering. The addition of surface moisture prior to machine calendering is intended to soften the surface fibers and not the fibers in the interior of the paper. Papers calendered with a high surface moisture content generally show greater strength, density, gloss, and processing chemistry resistance, all of which are desirable for an imaging support and have been shown to be perceptually preferred to prior art photographic paper bases.

There are several paper surface humidification/moisturization techniques. The application of water, either by mechanical roller or aerosol mist by way of an electrostatic field, are two techniques known in the art. The above techniques require dwell time, hence web length, for the water to penetrate the surface and equalize in the top surface of the paper. Therefore, it is difficult for these above systems to make moisture corrections without distorting, spotting, and swelling of the paper. The preferred method to rewet the paper surface prior final calendering is by use of steam. A steam rewetting of the paper is accomplished by utilizing saturated steam in a controlled atmosphere to cause water vapor to penetrate the surface of the paper and condense. Prior to calendering, the steam rewetting allows a considerable improvement in gloss and smoothness of the paper due to the heating and moisturizing the paper of this invention before the pressure nip of the calendering rolls. An example of a commercially available system that allows for controlled steam moisturization of the surface of cellulose paper is the "Fluidex System" manufactured by Pagendarm Corp.

The preferred moisture content by weight after applying steam and calendering is between 5% and 9%. A moisture level less than 5% is more costly to manufacture since more fiber is needed to reach a final basis weight. At a moisture level greater than 10%, the surface of the paper begins to degrade. After steaming the paper surface, the paper is calendered before winding of the paper. The preferred temperature of the calender rolls is between 24° C. and 121° C. Lower temperatures result in a poorer surface smoothness. Higher temperatures are unnecessary, as they do not improve the paper surface, require more energy, and will melt the polyester causing the material to adhere to the calender rolls.

As described above, the liquid barrier layer may be applied on to the paper base during the papermaking operation. Another option is to apply the holdout layer in a high speed off-line coating operation which offers the opportunity to add additional layers to the imaging element. These added layers which, although not required for good image quality, may allow product differentiation in such customer preference features as colorimetry (warm tones vs. cold tones), and surface (glossy vs. matte), while maintaining a more efficient and cost-effective production process Since there is no longer an opportunity to mask the raw paper surface with polyolefin resins or laminates, it is critical that the paper raw base be extremely smooth in order to provide a pleasing appearance on the final product. Surface roughness on imaging base papers is a measure of relatively finely spaced irregularities and has been measured using Ra or surface roughness average. The roughness average is the sum of the absolute value of the difference of each discrete data point from the average of all the data divided by the total number of points sampled. Papers surfaces with roughnesses less than 1.02 micrometers Ra are desired, although roughnesses up to 2.03 micrometers Ra are acceptable as long as they do not have an orange peel surface.

The terms as used herein, "top", "upper", "emulsion side" and "face" reference the side or toward the side of a photographic member bearing the imaging layers. The terms "bottom", "lower side" and "back" reference the side or toward the side of the photographic member opposite from the side bearing the photosensitive imaging layers or developed image. The term "face side" means the side opposite the side of cellulose paper formed on a fourdrinier wire. The term "wire side" means the side of cellulose paper formed adjacent to the fourdrinier wire.

As used herein, the phrase 'imaging element' comprises an imaging support as described above along with an image receiving layer as applicable to multiple techniques governing the transfer of an image onto the imaging element. Such techniques include ink jet printing, thermal dye transfer, laser printing, or electrophotographic printing, as well as a support for photographic silver halide images. As used herein, the phrase "photographic element" is a material that utilizes photosensitive silver halide in the formation of images. The thermal dye image-receiving layer of the receiving elements of the invention may comprise, for example, a polycarbonate, a polyurethane, a polyester, polyvinyl chloride, poly(styrene-co-acrylonitrile), poly (caprolactone), or mixtures thereof. The dye image-receiving layer may be present in any amount that is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention, provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form, the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the particle. Heating both removes residual liquid and fixes the toner to paper.

When used as inkjet recording media, the recording elements or media used in ink jet printing typically comprise a substrate or a support material having on at least one surface thereof an ink-receiving or image-forming layer. If desired, in order to improve the adhesion of the ink receiving layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, can be applied to the surface of the support. The ink receiving layer is preferably coated onto the support layer from water or water-alcohol solutions at a dry thickness ranging from 3 to 75 micrometers, preferably 8 to 50 micrometers.

Any known ink jet receiver layer can be used in combination with the external polyester-based barrier layer of the present invention. For example, the ink receiving layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like; derivatives of natural polymers such as functionalized proteins, functionalized gums and starches, and cellulose ethers and their derivatives; and synthetic polymers such as polyvinyloxazoline, polyvinylmethyloxazoline, polyoxides, polyethers, poly(ethylene imine), poly(acrylic acid), poly (methacrylic acid), n-vinyl amides including polyacrylamide and polyvinylpyrrolidone, and poly(vinyl alcohol), its derivatives and copolymers; and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of nonsolvent. In general, it is sufficient for the base layer to be hydrophilic, but not porous. This is especially true for photographic quality prints, in which porosity may cause a loss in gloss. Optionally, rigidity may be imparted to the base layer through incorporation of a second phase such as polyesters, poly(methacrylates), polyvinyl benzene-containing copolymers, and the like. In particular, the ink receiving layer may consist of any hydrophilic polymer or combination of polymers with or without additives as is well known in the art.

If desired, the ink receiving layer can be overcoated with an ink-permeable, anti-tack protective layer, such as, for example, a layer comprising a cellulose derivative or a cationically-modified cellulose derivative or mixtures thereof. An especially preferred overcoat is poly β-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water-based inks. The overcoat layer can also protect the ink receiving layer from abrasion, smudging, and water damage. In general, this overcoat layer may be present at a dry thickness of about 0.1 to about 5 $\mu$m, preferably about 0.25 to about 3 $\mu$m. In addition, a laminate or protective fluid may be applied after the element is imaged to improve the durability of the print.

In practice, various additives may be employed in the ink receiving layer and overcoat. These additives include surface active agents surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, wound wire rod coating, slot coating, slide hopper coating, gravure, curtain coating, and the like. Some of these methods allow for simultaneous coatings of both layers, which is preferred from a manufacturing economic perspective.

The inks used in the ink jet printing process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

Smooth opaque paper bases are useful in combination with silver halide images because the contrast range of the silver halide image is improved and show through of ambient light during image viewing is reduced. The photographic element of this invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100$\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above.

This invention in a preferred embodiment utilizes a radiation-sensitive emulsion comprised of silver halide grains (a) containing greater than 50 mole percent chloride based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula:

$$[ML_6]^n \quad \text{(I)}$$

wherein n is zero, −1, −2, −3, or −4; M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand; and (ii) an iridium coordination complex containing a thiazole or substituted thiazole ligand.

This invention is directed towards a photographic recording element comprising a support and at least one light sensitive silver halide emulsion layer comprising silver halide grains as described above.

The following example illustrates the practice of this invention. It is not intended to be exhaustive of all possible variations of the invention. Parts and percentages are by weight unless otherwise indicated.

EXAMPLES

Examples 1–5

Example 1 is made with a 100% bleached hardwood chemical pulp furnish comprising roughly 45% poplar, 30% maple, and 20% birch, respectively, using the following chemicals based on dry fiber weight: alkyl ketene dimer (0.20%), cationic starch (1.0%), polyaminoamide epichlorhydrin (0.25%), polyacrylamide resin (0.09%), diaminostilbene optical brightener (0.14%) and sodium bicarbonate (1%). Example 1 corresponds to a standard raw base manufactured for imaging purposes and is made using a starch based surface size. Example 2 is the same base described in Example 1 but unsized and with minimal calendering. Example 3 uses the base from Example 2 and coats it using a simple size tub application with 80% water and 20% aqueous dispersion of the hydrophobic polyester and carboxylated styrene butadiene resin blend by weight. The blend of hydrophobic polyester and carboxylated styrene butadiene is made by EvCote: type PWRHS-37 was used. The same process was employed in the manufacture of Example 4; however, the hydrophobic polyester and carboxylated styrene butadiene blend solution was applied at 10% solids instead of 20%. Comparisons to standard waterproof imaging papers are provided in Examples 5 and 6. Example 5 represents an imaging base laminated with polyolefin resin, while Example 6 is an imaging base extruded with polyethylene resin. These examples will demonstrate that imaging paper bases containing an aqueous polyester resin exhibit some advantages over standard paper and resin coated bases.

Table 1 below presents the composition of each of the papers of the invention and controls.

TABLE 1

| | Example 1 (control) Standard Imaging Base paper before waterproofing layers added | Example 2 (control) Pre-calender Fiber Base paper with typical fiber base "feel" | Example 3 Base paper | Example 4 Base paper | Example 5 (control) Standard imaging paper with waterproofing layers and emulsion added | Example 6 (control) Standard Imaging paper with waterproofing layers and emulsion added |
|---|---|---|---|---|---|---|
| Waterproofing layers | none | none | see sizing condition | see sizing condition | laminated polyolefin | polyethylene coated |
| sizing condition | traditional starch based size | Unsized | 20% Solids EvCote PWRHS-37 | 10% Solids EvCote PWRHS-37 | traditional starch based size | traditional starch based size |
| BASIS WGT (g/m2) | 157.20 | 136.06 | 140.70 | 137.18 | 244.49 | 221.25 |
| CALIPER cm | 0.014 | 0.016 | 0.015 | 0.015 | 0.023 | 0.020 |
| 40/20 ACID sec. | 200 | 1401 | 2329 | 2822 | NA | NA |
| L + W STIFF MD mN | 117 | 121 | 137 | 128 | 340 | 182 |
| L + W STIFF CD mN | 70 | 60 | 64 | 55 | 257 | 100 |
| Adjusted Stiffness MD | 111 | 111 | 138 | 129 | 90 | 65 |
| Adjusted Stiffness CD | 67 | 55 | 65 | 55 | 68 | 36 |
| POROSITY | 65 | 265 | 100 | 135 | 0 | 0 |
| SHEFFIELD SMOOTHNESS | 14 | 62 | 44 | 48 | 5 | 44 |
| Ra micrometers | 0.94 | 1.88 | 1.32 | 1.52 | n/a | n/a |
| HUNTER L* UVO | 94.1 | 94.2 | 94.17 | 94.19 | 95.64 | 92.83 |
| HUNTER A* UVO | −0.39 | −0.28 | −0.32 | −0.31 | −0.43 | −0.44 |
| HUNTER B* UVO | −0.61 | −0.4 | −0.33 | −0.35 | −0.07 | −3.08 |
| OPACITY | 91.1 | 93 | 93 | 93.2 | 99.8 | 98.5 |
| logo side STATIC FRICTION | N/A | 0.24 | 0.21 | 0.21 | 0.47 | 0.46 |
| logo side DYNAMIC FRICTION | N/A | 0.19 | 0.14 | 0.15 | 0.35 | 0.43 |

Waterproofing and liquid barrier properties of the paper after sizing were measured with the use of a 40/20 Acid Valley Test. One method of checking penetration resistance of papers to various solutions is to use the 40/20 Acid Valley test. In this test method the time required for a penetrant to penetrate into the paper and decrease the electrical resistance of the paper is measured. The equipment consists of a reservoir filled with penetrant that is raised during the test to supply penetrant via hoses attached to cell blocks to both sides of the paper being tested. The electrical circuit is first tested without the penetrant or paper in place. An AC voltage of 6.0±/−0.5 volts is applied, and the rheostat is adjusted to read 40 milliamps. For the paper test, three samples of conditioned paper (TAPPI method T402 om 93) are cut to 3"×5" size. The timer is zero'd. The first test sample is clamped vertically between two cell blocks, which hold the paper edges rigidly while the penetrant is being applied to the paper surface. The penetrant reservoir is then raised, which delivers the penetrant simultaneously to the cell blocks located on either side of the paper. When the reservoir is raised, such that penetrant contacts the paper, the timer is also automatically started. When the preset level of 20 milliamps is reached, the timer buzzes and stops. The seconds needed to achieve the 20 milliamp level are recorded. The faster the penetrant penetrates into the sheet and reduces the electrical resistance of the paper, the lower the number of seconds needed to reach a 20 milliamp level. The more resistant a paper is to penetration by the liquid, the longer the time required. The penetrant used is a 60% acetic acid solution. After completing the first test, the remaining two conditioned samples are run, and the three test results are then averaged.

The results from Table 1 clearly show the improvement in liquid holdout from a typical starch sized paper (Example 1—200 seconds) as compared to an aqueous polyester sized paper (Example 3—2329 seconds). The papers in both cases were the same with regard to chemistry and pulp furnish except for the external size application. Holdout characteristics improved more than 1000% and ere significantly improved over a typical starch sized paper even at lower dilution rates (Example 4).

Stiffness was measured using a Lorentzen and Wetter type tester according to Tappi Method T 556. The bending resistance in milliNewtons of a 20 mm wide vertically clamped sample is measured for a 15° deflection angle. Measured stiffness was then adjusted to remove weight and caliper differences between papers using the following equation:

$$\text{Adjusted stiffness}=(\text{raw stiffness}*100)/(\text{avg. caliper})^{(2+(\text{apparent density})/1.54)}$$

As can be seen by comparing the raw fiber paper samples alone (Examples 1–4), size coating with the polyester resin helped to increase the adjusted stiffness values in both the MD (machine direction) and CD(cross direction) of the paper by up to 24%. Although "plastic" coated papers at similar weights were not available, it can be seen that when normalized for the effect of caliper (stiffness is a function of the cube of the caliper) that the samples sized with aqueous polyester resins were advantaged over typical imaging base papers coated with polyethylene and laminated with polyolefin layers. Colorimetry was measured using a Hunter Ultra Scan colorimeter configured at D65/10 with ultraviolet out filter located at 460 nm, specular reflectance included, single thickness, black by black. Colorimetry values of the polyester coated resins were in the acceptable range for imaging bases as were opacity values.

Opacity was measured according to ASTM method E308-96, specular reflectance was included, and the testing was done by measuring one sheet black by black and then black by white (Baryta). Opacity increased slightly with the introduction of aqueous polyester resins as compared to a starch size coated fiber base sheet.

Smoothness was measured according to Tappi Method T538—'Roughness of paper and paperboard (Sheffield Method)'. This method involves a measurement of the air flow between the specimen (backed by flat glass on the bottom side) and two pressurized, concentric annular lands that are impressed into the sample from the topside. The rate of air flow is related to the surface roughness of paper and paperboard. Sample porosity was also measured using the Sheffield equipment and TAPPI Method T547—'Air permeance of paper and paperboard (Sheffield Method)'. It is a suitable test for smooth papers such as the examples described, since it measures air flow that not only passes through the specimen, but also air leakage across the surface. Air permeance is measured using a pressure differential of 10 kPa across a circular specimen area. Both smoothness and porosity were in the acceptable ranges for imaging papers. Coating with the aqueous polyester resin did show a slight improvement in surface and made the paper less porous.

"Paper feel" was inferred from the differences in static and dynamic friction between typical fiber base photographic papers versus resin coated and polyolefin laminated papers. Friction measurements were taken by attaching a paper specimen of 16.77 $cm^2$ to a sled weighing 100.4 grams and measuring the force required to continue pulling the sled at 46.99 cm/min across a bottom specimen or standard test material. The Coefficient of dynamic Friction was then calculated as the force in grams divided by the weight of the sled. The coefficient of static friction measured in a similar manner except the force to initiate movement rather than continue movement is used in the equation. As shown on Table 1, the coefficients of static and dynamic friction of the paper of the invention correspond closely to those of starch-sized paper and are significantly different from typical polyolefin resin coated or laminated supports.

Writability tests were performed using a wide variety of writing instruments including conventional ballpoint pen, solvent fiber tip pens (OHP permanent marker), aqueous fiber tip pens, aqueous rolling ball pens, #2 pencil, and #3 pencil. Marks were evaluated for drying/fix time, writing density, and ease of writing base on lubricity such as whether they dig or drag. Results were evaluated on a basis of 1–5 with 5 being the best and 1 being the worst. The samples sized with aqueous polyester resins showed improved performance versus resin coated and laminated paper for all five pencil tests and equal or better performance for all ink tests. Writability results approached fiber paper as represented by a "copy paper" sample.

The invention has been described in detail with particular reference to certain preferred embodiments thereof, but it will be understood that variations and modifications can be effected within the spirit and scope of the invention.

What is claimed is:

1. An imaging member comprising at least one image layer and a base, said base comprising a cellulose paper that has its surfaces impregnated with water dispersible ester-based condensation polymer wherein the surface of said base has a roughness of less than 2.03 $\mu$m Ra and a hydrophobicity as measured by 40/20 Acid Valley test in excess of 500 seconds and said member has a matte finish.

2. The imaging member of claim 1 wherein said base has a roughness of less than 1.03 $\mu$m Ra.

3. The imaging member of claim 1 wherein said base has been treated by corona discharge treatment with a range of 646 to 1615 joules/m$^2$ to provide increased oxidized functional groups thereby insuring adhesion for subsequent layers.

4. The imaging member of claim 1 wherein said base has a basis weight of between 110.0 and 250.0 g/m$^2$.

5. The imaging member of claim 1 wherein said water dispersible ester based condensation polymer comprises carboxylated polyester.

6. The imaging member of claim 1 wherein said base has an impregnated layer at the surface of 25% thickness.

7. The imaging member of claim 1 wherein said base has a water resistance of greater than 500 seconds.

8. The imaging member of claim 1 wherein said image layer comprises photosensitive silver halide.

9. The imaging member of claim 1 wherein said image layer comprises an ink jet receiving layer.

10. The imaging member of claim 1 wherein said image layer comprises a thermal transfer receiving layer.

11. The imaging member of claim 1 wherein said water dispersible ester based condensation polymer is used in a 1:1 ratio with styrene butadiene.

12. The imaging member of claim 9 wherein said imaging member resists cockle.

13. The imaging member of claim 8 wherein the back of said member has a paperlike feel as inferred by static and dynamic friction results of less than 0.30.

14. The imaging member of claim 1 wherein said water dispersible ester based condensation polymer comprises water dispersed transesterified polyester.

15. The imaging member of claim 1 wherein said ester-based condensation polymer comprises a water dispersible hydrophobic polyester resin having the following general formula:

$$I_n\text{-P—A}_m$$

wherein I is an ionic group; n is an integer in the range of 1–3 and defines the number of ionic groups; P is a polyester backbone; A is an aliphatic group; and m is an integer in the range of 3–8 and defines the number of aliphatic groups.

16. A method of forming an imaging base comprising providing a cellulose paper applying a water dispersible ester based condensation polymer to said paper, passing said paper impregnated with said condensation polymer between press rolls, wherein said paper has an average fiber length of between 0.40 and 0.90 mm, a roughness of less than 2.03 $\mu$m Ra, and an 40/20 Acid Valley Test of more than 500 seconds.

17. The method of claim 16 wherein said applying water dispersible ester based condensation polymer is carried out by passing said paper through a tank.

18. The method of claim 16 wherein said applying a water dispersed polyester is carried out by passing said paper through a nip between two rollers that are supplied with the said condensation polymer.

19. The method of claim 18 wherein said water dispersible ester based condensation polymer is metered to said nip.

20. The method of claim 18 wherein after said paper passes through said nip said paper has applied thereto a device to control application of said water dispersible ester based condensation polymer.

21. The method of claim 16 wherein said base has a roughness of less than 1.03 Ra.

22. The method of claim 16 wherein said base has a basis weight of between 110 and 250 g/m$^2$.

23. The method of claim 16 wherein said water dispersible ester based condensation polymer comprises carboxylated polyester.

24. The method of claim 16 wherein said base has an impregnated layer at the surface of 25% thickness.

25. The method of claim 16 wherein said base has a water resistance in excess of 2000 seconds as measured by 40/20 Acid Valley.

26. The method of claim 16 wherein said water dispersible ester based condensation polymer comprises a water dispersible hydrophobic polyester resin having the following general formula:

$$I_n\text{-P—A}_m$$

wherein I is an ionic group; n is an integer in the range of 1–3 and defines the number of ionic groups; P is a polyester backbone; A is an aliphatic group; and m is an integer in the range of 3–8 and defines the number of aliphatic groups.

27. An imaging member comprising at least one image layer and a base, said base comprising a cellulose paper that has its surfaces impregnated with water dispersible polyurethane-based condensation polymer wherein the surface of said base has a roughness of less than 2.03 $\mu$m Ra and a hydrophobicity as measured by 40/20 Acid Valley test in excess of 500 seconds.

28. The imaging member of claim 27 wherein said base has a roughness of less than 1.03 $\mu$m Ra.

29. The imaging member of claim 27 wherein said base has been treated by corona discharge treatment with a range of 646 to 1615 joules/m$^2$ to provide increased oxidized functional groups thereby insuring adhesion for subsequent layers.

30. The imaging member of claim 27 wherein said base has a basis weight of between 110.0 and 250.0 g/m$^2$.

31. The imaging member of claim 27 wherein said polyurethane condensation polymer comprises anionic or cationically functionalized diol monomers.

32. The imaging member of claim 27 wherein said base has a water resistance of greater than 500 seconds and frequently in excess of 2000 seconds as measured by 40/20 Acid Valley.

33. The imaging member of claim 31 wherein a cationically functional diol polymer comprising methyldiethanol amine is utilized as said polyurethane polymer.

34. The imaging member of claim 27 wherein said image layer comprises photosensitive silver halide.

35. The imaging member of claim 27 wherein said image layer comprises an ink jet receiving layer.

36. A method of forming an imaging base comprising providing a cellulose paper applying a water dispersed polyurethane based condensation polymer to said paper, passing said paper impregnated with said condensation polymer between press rolls, wherein said paper has an average fiber length of between 0.40 and 0.90 mm, an Ra less than 2.03 mum, and 40/20 Acid Valley Test of more than 500 seconds.

37. The method of claim 36 wherein said applying a water dispersed polyurethane based condensation polymer is carried out by passing said paper through a tank.

38. The method of claim 36 wherein said base has a Pentel pencil writability of greater than 4.

39. The method of claim 36 wherein said applying a water dispersed polyurethane is carried out by passing said paper through a nip between two rollers that are supplied with the said condensation polymer.

40. The method of claim 39 wherein said water dispersible polyurethane based condensation polymer is metered to said nip.

41. The method of claim 39 wherein after said paper passes through said nip, said paper has applied thereto a device to control application of said water dispersible polyurethane based condensation polymer.

42. An imaging member comprising at least one image layer and a base, said base comprising a cellulose paper that has its surfaces impregnated with water dispersible ester-based condensation polymer wherein the surface of said base has a roughness of less than 2.03 $\mu$m Ra and a hydrophobicity as measured by 40/20 Acid Valley test in excess of 500 seconds and said base has been treated by corona discharge treatment with a range of 646 to 1615 joules/m$^2$ to provide increased oxidized functional groups thereby insuring adhesion for subsequent layers.

43. The imaging member of claim 42 wherein said base has a roughness of less than 1.03 $\mu$m Ra.

44. The imaging member of claim 42 wherein said water dispersible ester based condensation polymer comprises carboxylated polyester.

45. The imaging member of claim 42 wherein said image layer comprises photosensitive silver halide.

46. The imaging member of claim 45 wherein said member has a matte finish.

47. The imaging member of claim 42 wherein said image layer comprises an ink jet receiving layer.

48. The imaging member of claim 42 wherein said image layer comprises a thermal transfer receiving layer.

49. The imaging member of claim 42 wherein said imaging member resists cockle.

50. The imaging member of claim 42 wherein said ester-based condensation polymer comprises a water dispersible hydrophobic polyester resin having the following general formula:

$$I_n\text{-P—}A_m$$

wherein I is an ionic group; n is an integer in the range of 1–3 and defines the number of ionic groups; P is a polyester backbone; A is an aliphatic group; and m is an integer in the range of 3–8 and defines the number of aliphatic groups.

51. An imaging member comprising at least one image layer and a base, said base comprising a cellulose paper that has its surfaces impregnated with water dispersible ester-based condensation polymer wherein the surface of said base has a roughness of less than 2.03 $\mu$m Ra and a hydrophobicity as measured by 40/20 Acid Valley test in excess of 500 seconds and said image layer comprises photosensitive silver halide.

52. The imaging member of claim 51 wherein said base has a roughness of less than 1.03 $\mu$m Ra.

53. The imaging member of claim 52 wherein said base has been treated by corona discharge treatment with a range of 646 to 1615 joules/m$^2$ to provide increased oxidized functional groups thereby insuring adhesion for subsequent layers.

54. The imaging member of claim 51 wherein said base has a water resistance of greater than 500 seconds.

55. The imaging member of claim 54 wherein said member has a matte finish.

56. The imaging member of claim 51 wherein the back of said member has a paperlike feel as inferred by static and dynamic friction results of less than 0.30.

57. The imaging member of claim 51 wherein said ester-based condensation polymer comprises a water dispersible hydrophobic polyester resin having the following general formula:

$$I_n\text{-P—}A_m$$

wherein I is an ionic group; n is an integer in the range of 1–3 and defines the number of ionic groups; P is a polyester backbone; A is an aliphatic group; and m is an integer in the range of 3–8 and defines the number of aliphatic groups.

58. An imaging member comprising at least one image layer and a base, said base comprising a cellulose paper that has its surfaces impregnated with water dispersible ester-based condensation polymer wherein the surface of said base has a roughness of less than 2.03 $\mu$m Ra and a hydrophobicity as measured by 40/20 Acid Valley test in excess of 500 seconds and said image layer comprises an hydrophilic polymer ink jet receiving layer.

59. The imaging member of claim 58 wherein said base has a roughness of less than 1.03 $\mu$m Ra.

60. The imaging member of claim 59 wherein said base has been treated by corona discharge treatment with a range of 646 to 1615 joules/m$^2$ to provide increased oxidized functional groups thereby insuring adhesion for subsequent layers.

61. The imaging member of claim 58 wherein said base has a basis weight of between 110.0 and 250.0 g/m$^2$.

62. The imaging member of claim 61 wherein said base has a water resistance of greater than 500 seconds.

63. The imaging member of claim 61 wherein said member has a matte finish.

* * * * *